US005693246A

United States Patent [19]

Han et al.

[11] Patent Number: 5,693,246

[45] Date of Patent: Dec. 2, 1997

[54] MICROWAVE OVEN HAVING A VERTICALLY ADJUSTABLE RADIANT HEATER

[75] Inventors: Dae Sung Han; Chang Woo Lee, both of Suwon, Rep. of Korea

[73] Assignee: Samsung Electronics Co., Ltd., Suwon, Rep. of Korea

[21] Appl. No.: 683,666

[22] Filed: Jul. 16, 1996

[30] Foreign Application Priority Data

Aug. 8, 1995 [KR] Rep. of Korea ..... 1995-20470

[51] Int. Cl.[6] ..... H05B 6/68

[52] U.S. Cl. ..... 219/685; 219/702; 219/404

[58] Field of Search ..... 219/685, 702, 219/404; 99/325

[56] References Cited

U.S. PATENT DOCUMENTS

| | | | |
|---|---|---|---|
| 4,357,513 | 11/1982 | Kawata et al. | 219/685 |
| 4,488,025 | 12/1984 | Tanabe | 219/685 |
| 4,596,914 | 6/1986 | Morino | 219/685 |
| 4,629,850 | 12/1986 | Tanabe | 219/685 |
| 5,534,681 | 7/1996 | Hwang | 219/685 |

*Primary Examiner*—Philip H. Leung

*Attorney, Agent, or Firm*—Burns, Doane, Swecker & Mathis, L.L.P.

[57] ABSTRACT

A microwave oven includes a cooking chamber to which a high frequency can be supplied. An electric heater is disposed in the cooking chamber for cooking by radiant heat. The heater is vertically movable by a motorized power transfer mechanism between upper and lower positions for regulating the intensity of the radiant heat cooking.

3 Claims, 5 Drawing Sheets

MICROWAVE OVEN HAVING A VERTICALLY ADJUSTABLE RADIANT HEATER

TECHNICAL BACKGROUND

The present invention relates to a microwave oven, and more particularly, a microwave oven having a radiant heater.

Microwave ovens convert electric energy into microwave energy to heat or cook foods quickly. Recently developed has been a microwave oven with an electric heater to supplement the cooking operation by radiated heat. When cooking foods such as fish and meat by using such a microwave oven, the electric heater browns the foods while the microwave energy penetrates them to heat evenly and quickly, so that the taste and flavor of the foods are enhanced. Of course, the microwave energy or the radiated heat may be selectively used to cook the foods depending on the kind of foods and cooking methods.

Referring to FIG. 5 which illustrates a perspective view of a conventional microwave oven with an electric heater, the heater 11 is mounted on the top of the cooking chamber 10, and a tray 12 is mounted on the bottom so as to be slowly rotated with foods thereon. In such a microwave oven, since the heater 11 is fixedly mounted on the upper part of the cooking chamber 10, it is impossible to control the distance between the heater and the foods on the tray. Hence, when the volume of the foods on the tray is so small that the relative distance between the heater and the foods on the tray is long, the effect of the radiated heat is very insufficient, thus lengthening the cooking time. On the contrary, when the volume of the foods is so large that the relative distance between the foods and the heater is short, the foods are partly burned. Moreover, even when a single kind of food is cooked, it is preferable to control the amount of the heat radiated from the heater 11 according to the cooking time, but such a conventional microwave oven can not provide such capability because the heater 11 is fixedly mounted. Namely, since there is required a great amount of heat at the start of cooking, the distance between the heater 11 and the foods must be short to increase the amount of the heat transferred from the heater 11 to the food, and then the amount of the heat transferred to the food must be gradually decreased in order to prevent the food from burning as time passes.

In order to eliminate such drawbacks, there has been proposed the use of a base rack which is manually put into the cooking chamber to regulate the relative distance between the food and the heater 11 according to the volume and kind of foods. However, this manual operation of the base rack, on which the food is held, is not only inconvenient, but also does not provide the optimum cooking because the relative distance can not be controlled as time passes.

SUMMARY OF THE INVENTION

It is an object of the present invention to provide a microwave oven having a heater raising and lowering apparatus for regulating the height of an electric heater so as to automatically control the position of the heater according to the kind of food being cooked and the cooking time.

According to an embodiment of the present invention, a heater raising and lowering apparatus for regulating the height of an electric heater comprises a motor for generating a drive force, a moving member which is raised or lowered with an electric heater mounted on its upper end, power transfer means for transferring a drive force of the motor to the moving member, and a support member for supporting the power transfer means.

Preferably, the power transfer means comprises a drive gear rotated by the motor, at least are reduction gear driven by the drive gear, and a pair of links respectively connected with the reduction gear and moving member so as to change the rotational motion of the reduction gear into rectilinear motion of the moving member.

The drive gear is preferably formed as a worm gear, and the reduction gear is formed as a spur gear, so as to receive the drive force of the motor which is capable of rotating clockwise and counterclockwise. The drive gear and reduction gear may consist only of spur gears.

The moving member has a plurality of rollers mounted on its opposite side surfaces, and the support member has a pair of guide rails for guiding the rollers, so as to smoothly move the moving member upward or downward. Further, a pair of limit switches are provided at a given distance from each other to stop the motor at upper and lower limits of the heater.

In the heater raising and lowering apparatus for regulating the height of the heater, the operation of the motor is controlled by a microcomputer preprogrammed according to the kind and amount of foods and the cooking time to rotate the drive gear and reduction gear of the power transfer means, so that the links are rotated by a given angle so as to move the moving member rectilinearly upward or downward. Accordingly, the heater mounted on the upper end of the moving member is moved upward or downward. Thus the relative distance between the heater and the food can be regulated. The position of the heater may be controlled between the upper and lower limit switches by controlling the operating time and the rotational direction of the motor. In this way, the amount of the heat transferred from the heater to the food is controlled depending on the kind and amount of the food and the cooking time, resulting in the optimum cooking.

The present invention will now be described more specifically with reference to the drawings attached only by way of example.

BRIEF DESCRIPTION OF THE ATTACHED DRAWINGS

FIG. 2 is a vertical cross-sectional view of the microwave oven of FIG. 1 with the electric heater moved to an uppermost position by;

DETAILED DESCRIPTION OF PREFERRED EMBODIMENTS

Figure 1:
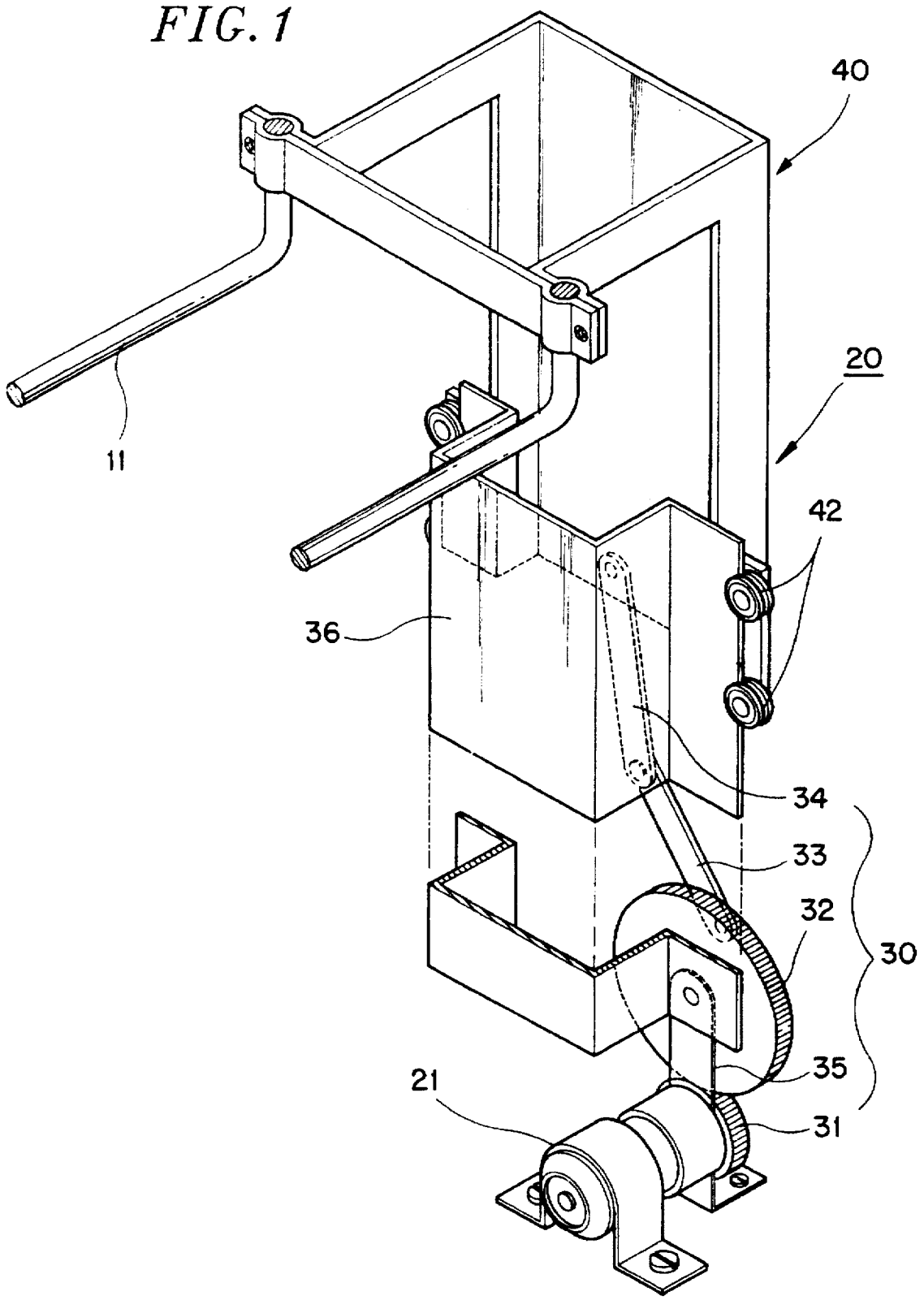
FIG. 1 is a perspective view which illustrates a heater raising and lowering apparatus for regulating the height of an electric heater according to one embodiment of the present invention.

Referring to FIG. 1, a heater raising and lowering apparatus 20 comprises a reversible motor 21 for generating a drive force, a moving member 40 which is raised or lowered with an electric heater 11 mounted on its upper end, power transfer means 30 for transferring the drive force of the motor 21 to the moving member 40 to be lifted up or down, and a support member 35 for supporting the power transfer means 30.

The power transfer means 30 further comprises a drive gear 31 rotated by the motor 21, at least one reduction gear 32 engaged with the drive gear 31, and a pair of links 33 and 34 respectively connected with the reduction gear 32 and moving member 40 so as to change the rotational motions of the reduction gear 32 into rectilinear motions of the moving member 40. The drive gear 31 and reduction gear 32 are formed as spur gears. Although the reduction gear 32 consists of a single spur gear in the present embodiment, it may instead consist of a plurality of gears if there is need for obtaining a desired reduction rate.

The reduction gear 32 is rotatably mounted on the support member 35 engaged with the drive gear 31. One end of the first link 33 is hinged on one side surface of the reduction gear 32 near the edge thereof while one end of the second link 34 is hinged on the lower end of the moving member 40. The other ends of the first and second links 33 and 34 are hinged to each other and rotated by the reduction gear 32. Thus, the required number of rotations of the motor 21 is reduced by means of the drive gear 31 and the reduction gear 32, and the links 33 and 34 serve to move the moving member 40 rectilinearly upward and downward.

A plurality of rollers 42 are mounted on both sides of the lower part of the moving member 40 while the heater 11 is mounted on the upper end of the moving member 40. The rollers 42 are engaged with the guide rails 36 (refer to FIG. 2) attached to the outside wall of the cooking chamber 10. The second link 34 is hinged on the rear side wall of the moving member 40. Thus, as the first and second links 33 and 34 rotate, the rollers 42 roll along the guide rails 36 to move the moving member 40 rectilinearly upward and downward.

Figure 2:
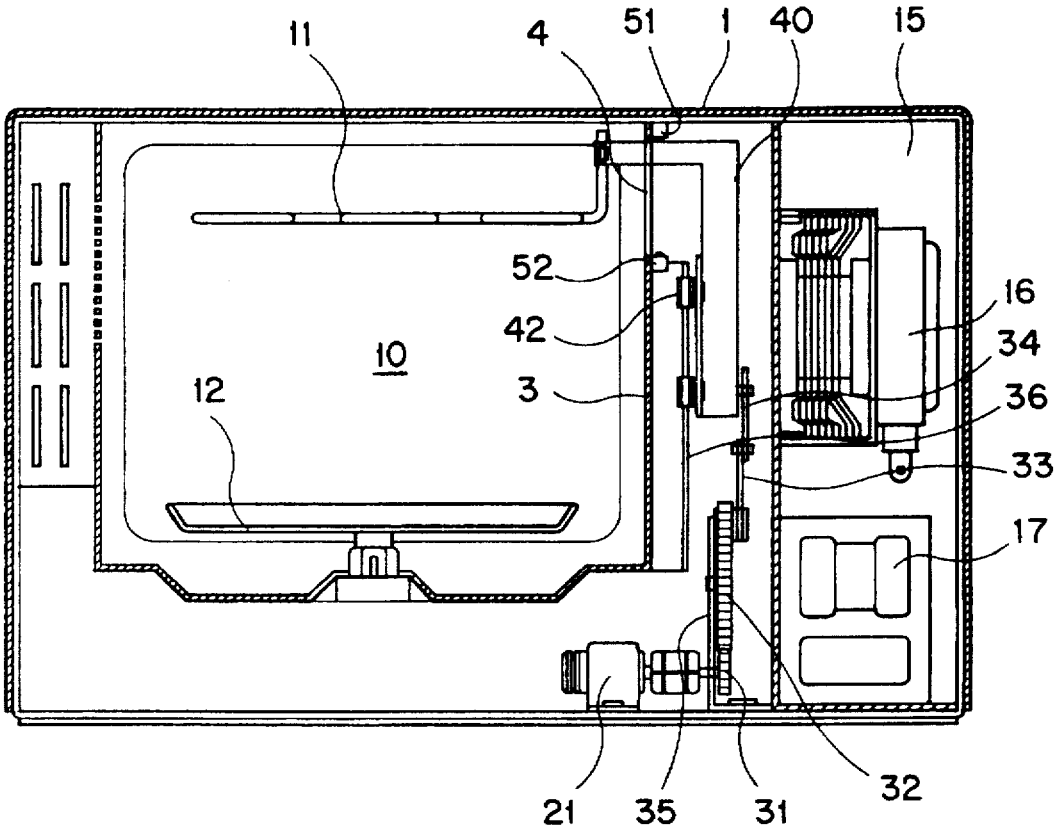
Figure 3:
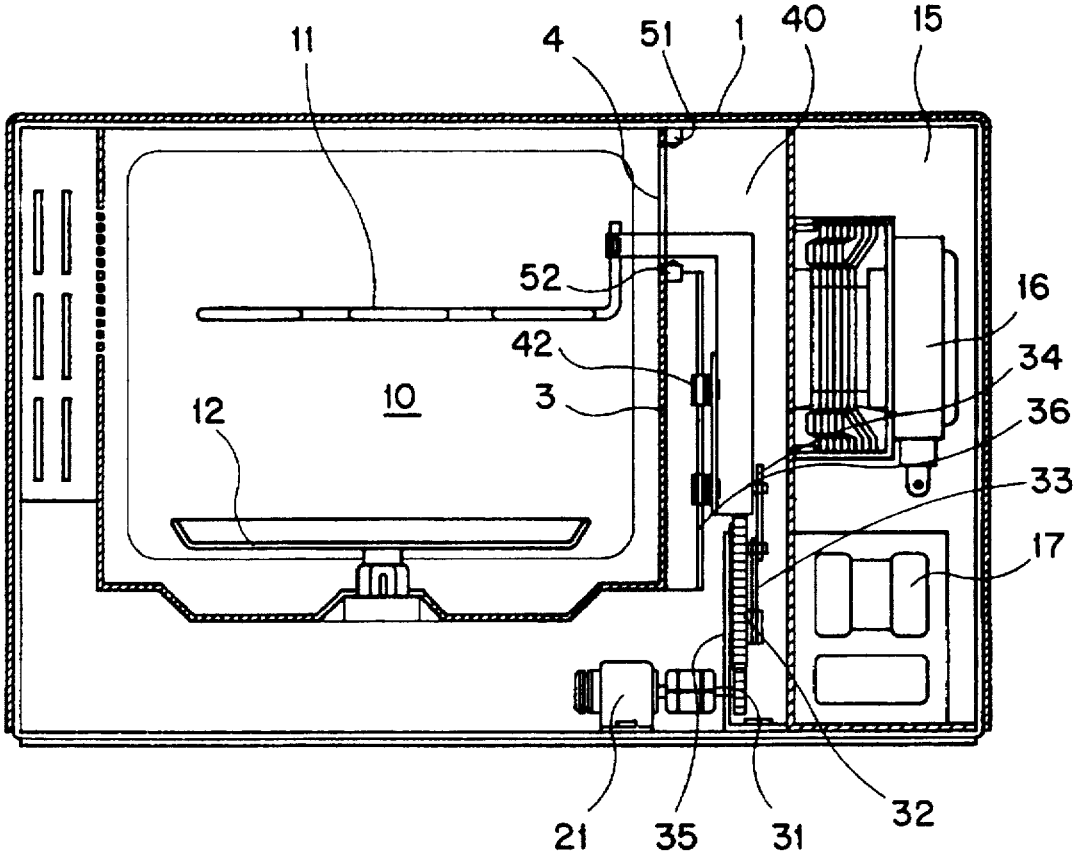
FIG. 3 is a view similar to FIG. 2 with the electric heater moved to a lowermost position.

Referring to FIGS. 2 and 3, the heater raising and lowering apparatus 20 is installed between the cooking chamber 10 and the electric equipment compartment 15 for mounting various electrical parts such as a magnetron 16 and a high voltage transformer 17. The motor 21 and support member 35 are fixedly mounted on the bottom of the body 1, and the guide rails 36 are fixedly mounted on a side wall 3 of the cooking chamber 10. On the upper part of the side wall 3 is provided an aperture 4 for allowing the upper part of the moving member 40 with the heater 11 to freely move upward and downward. The drive gear 31 and reduction gear 32 are rotatably supported on the support member 35 while the moving member 40 is connected to the reduction gear 32 through the first and second links 33 and 34. The rollers 42 mounted on the lower part of the moving member 40 are engaged with the guide rails 36.

Additionally provided on the side wall 3 of the cooking chamber 10 are upper and a lower limit switches 51 and 52 with a given space between them to detect the upper and lower limit positions of the heater 11 to send a stop signal of the motor 21 to a control part (not shown).

In operation, foods are firstly deposited on the tray 12 of the cooking chamber, and a cooking time or a cooking mode is inputted into the control part. Then, the motor 21 is rotated in one direction so as to move the heater 11 downward. This is to decrease the relative distance between the foods and the heater 11 because there is required a relatively greater amount of heat in the initial step of cooking. As the motor 21 rotates, the drive gear 31 and the reduction gear 32 rotate to reduce the rotational speed of the motor 21. At the same time, the first and second links 33 and 34 rotate slowly to move the rollers 42 of the moving member 40 downward along the guide rails 36. At the end of the downward motion of the moving member 40, the upper part of the moving member 40 presses the lower limit switch 52 to stop the motor 21 by means of the control part, so that the heater 11 is maintained at the lowermost position as shown in FIG. 3. After the foods are strongly irradiated by the heat of the heater 11 for a given time, the relative distance between the foods and the heater 11 should be increased so as to gradually ripen the foods. The position of the heater 11 and the pausing time are automatically regulated by the control part.

When the motor 21 is rotated in the opposite direction in order to lift the heater, the gears 31, 32 and the links 33 and 34 serve to gradually lift the moving member 40. At the end of the upward movement, the moving member 40 presses the upper limit switch 51 to stop the motor 21 by means of the control part, so that the heater 11 is maintained at the uppermost position as shown in FIG. 2. Thus, the foods are weakly heated by the heater 11 and gradually ripened.

Although the heater 11 is described to be maintained only at the uppermost and the lowermost positions in the present embodiment, it may be maintained at various positions between the uppermost and the lowermost positions by controlling the motor 21 so as to properly cook the foods according to the characteristics of the foods.

Figure 4:
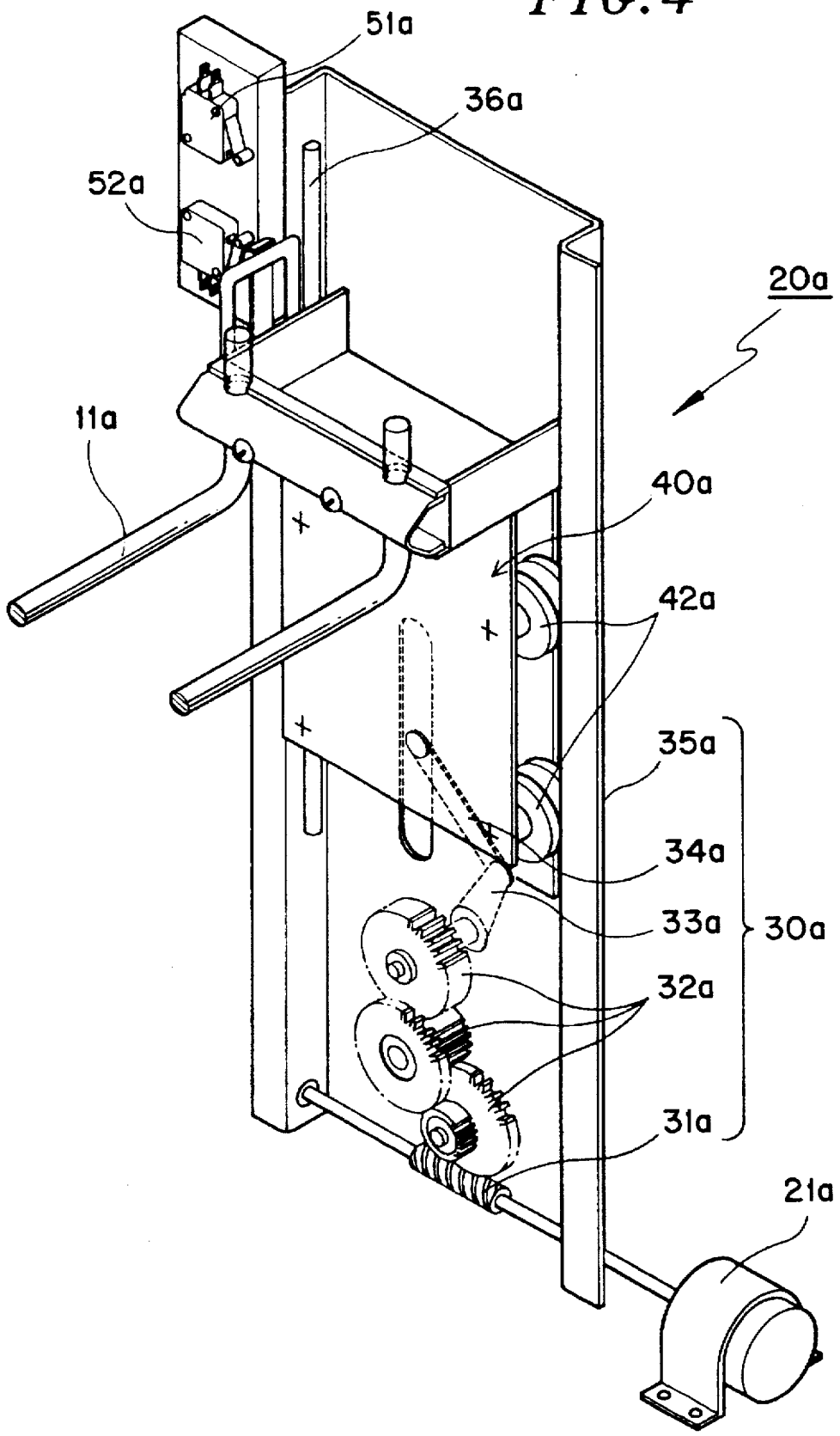
FIG. 4 is a perspective view which illustrates a heater raising and lowering apparatus for regulating the height of an electric heater according to another embodiment of the present invention.
Figure 5:
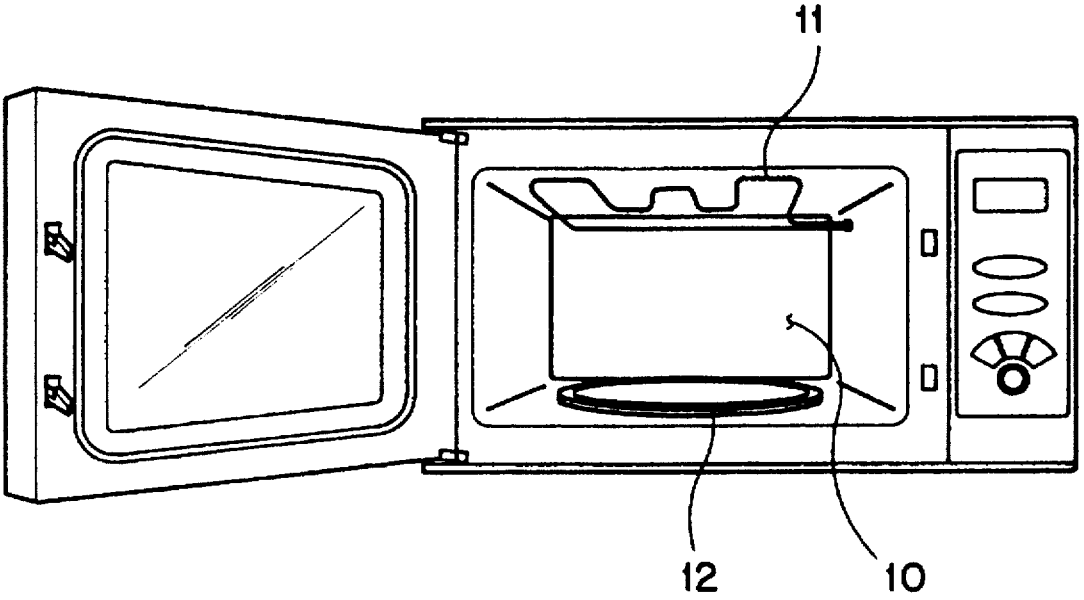
FIG. 5 (PRIOR ART)
FIG. 5 is a perspective view which illustrates a conventional microwave oven with an electrical heater fixedly attached.

Referring to FIG. 4 for illustrating another embodiment of the present invention, a heater raising and lowering apparatus **20*a* has substantially the same construction as the first embodiment. Namely, the heater raising and lowering apparatus 20*a* comprises a motor 21*a* for generating a drive force, a moving member 40*a* provided with an electric heater 11*a* and rollers 42*a*, a power transfer means 30*a* for changing the rotational motion of the motor into rectilinear upward and downward motion, and a support member 35*a* for supporting the power transfer means 30*a***.

The power transfer means **30*a* comprises a drive gear 31*a* of the worm gear type connected with the motor 21*a*, a plurality of reduction gears 32*a*, which are formed as spur gears engaged with the drive gear 31*a*, and a pair of links 33*a* and 34*a* respectively connected with the reduction gear 32*a* and the moving member 40*a*** to change the rotational motion into the rectilinear motion.

The support member **35*a* has a lower part for mounting the motor 21*a*, drive gear 31*a* and a plurality of reduction gears 32*a*, and a upper part for mounting the guide rails 36*a* at both side surfaces. Thus, the moving member 40*a* is supported via the pair of links 33*a* and 34*a* on the reduction gear 32*a* while the rollers 42*a* are engaged with the guide rails 36*a*. In the present embodiment, the upper and the lower limit switch 51*a* and 52*a* are mounted on the upper part of the support member 35*a*. The apparatus 20*a* has the same structure as the first embodiment except that the reduction gears 32*a* consisting of spur gears are engaged with the drive gear 31*a*** which is formed a worm gear, and therefore further description of the operation is omitted.

What is claimed is:

1. A microwave oven comprising:

a cooking chamber;

a high frequency generator for supplying high frequency to the cooking chamber;

an electric heater disposed in the cooking chamber and mounted for vertical movement; and a heater raising-and-lowering mechanism for raising and lowering the heater, comprising:

a moving member carrying the heater and being vertically movable, the moving member carrying rollers, a reversible motor for generating a drive force, a support member forming a pair of vertical rails engaged by respective ones of the rollers whereby the moving member moves vertically along the support member, a power transfer mechanism mounted on the support member for transferring the drive force to the moving member for raising and lowering the moving member and heater, the power transfer mechanism comprises a drive gear rotated by the motor, a reduction gear driven by the drive gear about a first axis, and a pair of links, one of the links being pivotably connected to the reduction gear for pivoting about a second axis and the other of the links being pivotably connected to the moving member for pivoting about a third axis, both links being pivotably connected to each other for pivoting about a fourth axis for converting rotational movement of the reduction gear into rectilinear movement of the moving member, the second, third and fourth axes being parallel to the first axis, and vertically spaced limit switches operably connected to the motor and engageable by the moving member for defining upper and lower limits of the heater.

2. The microwave oven according to claim 1 wherein the drive gear comprises a worm gear, and the reduction gear comprises a spur gear.

3. The microwave oven according to claim 1 wherein each of the drive gear and reduction gears comprises a spur gear.

* * * * *